US005252209A

United States Patent [19]

Retter

[11] Patent Number: 5,252,209

[45] Date of Patent: Oct. 12, 1993

[54] SOLID BOWL WORM CENTRIFUGE WITH IMPROVED DISCHARGE OPENINGS

[75] Inventor: Eric Retter, Cologne, Fed. Rep. of Germany

[73] Assignee: Kloeckner-Humboldt-Deutz AG, Fed. Rep. of Germany

[21] Appl. No.: 871,046

[22] Filed: Apr. 20, 1992

[30] Foreign Application Priority Data

Apr. 20, 1991 [DE] Fed. Rep. of Germany ..... 4112957

[51] Int. Cl.[5] ..... B04B 1/20

[52] U.S. Cl. ..... 210/380.3; 210/360.1; 494/52; 494/53; 494/56

[58] Field of Search ..... 210/512.1, 360.1, 365, 210/378, 380.1, 380.3, 402, 781; 494/50, 52, 53, 55, 56, 59, 74

[56] References Cited

U.S. PATENT DOCUMENTS 4,743,226 5/1988 Day et al. ..... 494/53

5,169,377 12/1992 Schlip et al. ..... 210/781

*Primary Examiner*—Robert A. Dawson
*Assistant Examiner*—David Reifsnyder
*Attorney, Agent, or Firm*—Hill, Steadman & Simpson

[57] ABSTRACT

A centrifugal separator for the separation a slurry into a light phase fraction and a heavy phase fraction including a rotatable shell having a cylindrical portion and a conical portion with a rotatable auger therein and a light phase opening at one end and a heavy phase opening at a second end sized to throttle the flow of light phase liquid and heavy phase liquid and sized in the cross-sectional area ratio of A/B so that the discharge from the separator will continue to be in the ratio of A/B regardless of throughput and in one form the separator has a second heavy phase opening in the cylindrical portion and in another form, an annular barrier vane on the auger blocking flow of liquid fraction toward the heavy fraction opening.

14 Claims, 1 Drawing Sheet

SOLID BOWL WORM CENTRIFUGE WITH IMPROVED DISCHARGE OPENINGS

BACKGROUND OF THE INVENTION

The invention relates to improvements in solid bowl worm centrifuges for the continuous separation of slurries containing substances differing in density and for separating the slurries into a light phase fraction and a heavy phase fraction.

More particularly, the invention relates to providing an improved solid bowl worm centrifuge which has a basket shell having a cylindrical portion at one end which receives and discharges the light phase and a conically tapering portion at the other end for discharging the heavy phase fraction. Discharge openings are provided in the first end for the light phase and discharge openings are provided in the conical end for the heavy phase. The bowl is driven in rotation and an auger is located therein independently driven in rotation.

A solid bowl worm centrifuge which has radial discharge nozzles for the heavy phase in the basket shell has been known and in such structure, the nozzle apertures projecting into the inside of the centrifuge are periodically opened and closed by a control element. The control element moves across the openings a short distance and is provided with release openings which are periodically opened and closed based on the measure of differential speed between the nozzle apertures and control element. These nozzle apertures are located at the beginning of the short steep conical part of the drum where the especially coarse solids are discharged.

In such a known solid bowl worm centrifuge which includes a nozzle discharge, one difficulty encountered is that the nozzle cross-sections allow only a limited quantity of solids per unit of time. An adaptation of this quantity on the basis of changing intake conditions during operation is not practically possible.

As a consequence thereof, a change or adjustment can be achieved only when the machine is shut down and brought to a standstill so that the nozzles can be replaced or the control element can be changed.

Further, only nozzles having a relatively small bore diameter can be employed and, for example, such diameters range between 3 and 10 mm. This is to be attributed to the fact that high static pressures are present in the heavy phase as a consequence of the high centrifugal acceleration at the nozzle aperture. With larger diameters, a plug of heavy phase could shoot through the nozzles at the time of opening and cause a flow collapse of the light phase situated above. This must be avoided under all circumstances, and therefore compels the provision of very small nozzle diameters.

It is accordingly an object of the present invention to provide a centrifuge wherein a matching of the withdrawable quantity of heavy phase due to changing intake conditions during ongoing operation is possible within a reasonable range of control.

A further object of the invention is to provide an improved centrifuge wherein the ratio of light phase material to the heavy phase material withdrawn is maintained relatively constant with a change in input to the separator due to changing intake conditions during ongoing operation.

FEATURES OF THE INVENTION

In accordance with the principles of the invention, the radial spacing of the discharge openings from the drum axis can be small. Thus, the centrifugal acceleration at this location need not be as high in centrifuges heretofore used. That is, the hydrostatic pressures acting due to the liquid column situated above the discharge openings are noticeably lower than in the known centrifuges. This makes it possible to have the discharge openings have larger cross-sections than have heretofore been possible.

Also as an advantage of the arrangement of the present design, the discharged quantity of the heavy phase automatically adapts to the intake conditions. The hydrostatic pressure exerted on the heavy phase by the liquid column above the discharge openings expresses the heavy phase through the discharge openings. When the intake quantity is changed, the height of the liquid column changes as a consequence of the throttle effect of the discharge openings. Thus, the existing hydrostatic pressure which has a direct influence on the quantity of heavy phase expressed from the discharge opening varies in accordance with the throughput. Since the liquid column above the discharge opening has a relatively small height which is less than in known centrifuges, even slight height differences have a pronounced effect on the discharge quantity so that automatic discharge adaptation to intake conditions is established in the present centrifuge.

As a further advantage of the design of the present invention, the discharge openings for the light phase are designed so that they exert a throttling effect on the light phase to be discharged. This obtains a further enhancement of the sensitivity of the automatic effect of the discharge control since the change in intake conditions now will have an even more pronounced effect on varying the height of the liquid level. This, therefore, reacts even more strongly on the discharged quantities. With an application of the relationship of the aperture cross-sections for the light phase and the heavy phase, it is possible to keep the discharge ratio of the light phase to the heavy phase nearly constant over a greater range of variation in the quantity supplied to the centrifuge.

In a preferred form of the invention, the basket shell has a cylindrical section and a tapered conical section. The discharge openings for the heavy phase are positioned in the conical part of the basket shell, and in one form provides an additional heavy phase opening in the cylindrical part. A constant subquantity of heavy phase is steadily discharged through the additional discharge openings in the cylindrical portion so that the discharge openings that control the discharge quantity now have to discharge and regulate only the remaining subquantity of the heavy phase. This provides an even further-reaching sensitive automatic adaptation of the overall discharge quantity relative to fluctuations in the intake conditions.

In a further alternative arrangement of the invention, a retaining mechanism is provided for the light phase which is located preceding the discharge openings for the heavy phase. This retaining mechanism insures that no light phase can emerge at the discharge openings for the heavy phase when disproportionately great fluctuations in intake conditions occur. One form of this retaining device can be fashioned as an annular disk extending radially from the auger support shaft and providing an annular axial passage or plurality of passages for the heavy phase against the surface of the basket shell. The retaining device can be formed as a simple weir plate that is secured to the worm shaft located between adjacent worm helixes and leaving a gap against the inner surface of the shell for the heavy phase.

Other objects, advantages and features will become more apparent with the teaching of the principles of the invention in connection with the disclosure of the preferred embodiments thereof in the specification, claims and drawings, in which:

DESCRIPTION OF THE PREFERRED EMBODIMENTS

Figure 1:
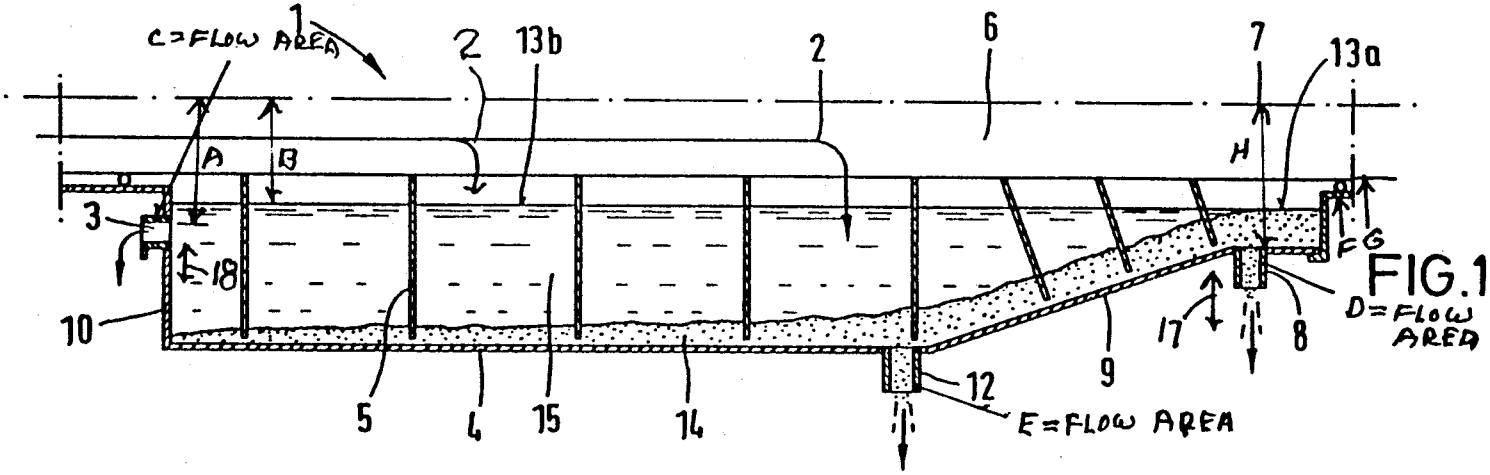
FIG. 1 is a partial longitudinal section taken through the axis of a solid bowl worm centrifuge constructed and operating in accordance with the principles of the present invention.
Figure 2:
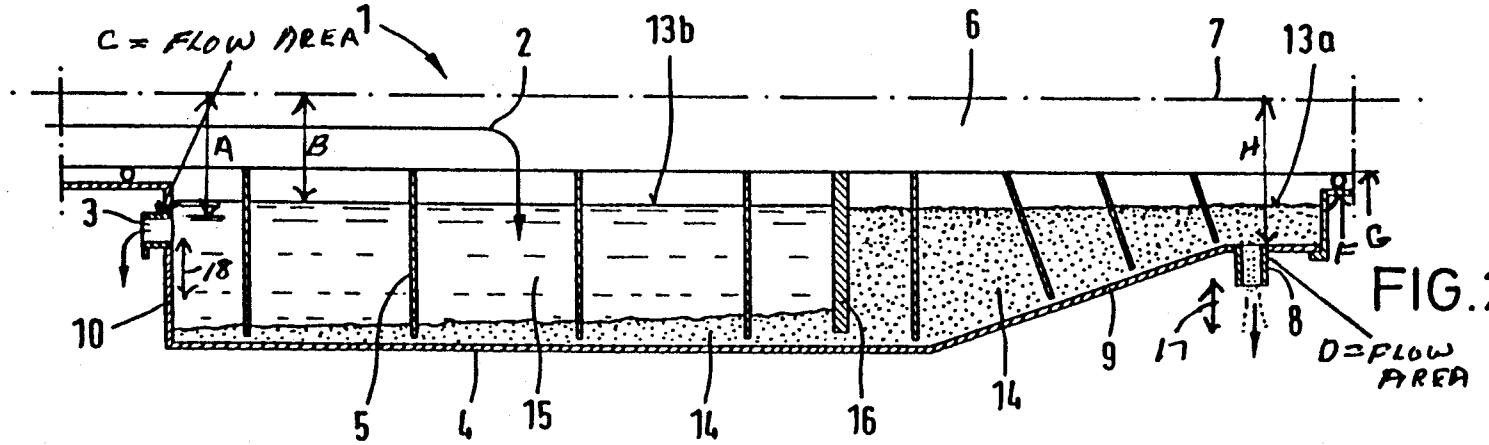
FIG. 2 is a partial longitudinal section taken through the axis of a solid bowl worm centrifuge illustrating the use of a retaining device between the light phase and heavy phase materials within the shell.

As illustrated in FIG. 1, a solid bowl worm centrifuge 1 is provided and is illustrated with only the lower half being shown. Since the bowl is substantially symmetrical, the illustration of the lower half will suffice for purposes of describing the features of the invention. FIG. 2 is illustrated in the same manner, and it will be understood that the upper portion of the bowl is of essentially the identical construction.

In the solid bowl worm centrifuge of FIG. 1, discharge openings 8 are provided for removal of the heavy phase.

The solid bowl centrifuge has a cylindrical portion 4 and a tapered conical portion 9. Within the centrifuge is an independently rotatable auger 5. Suitable drive means, not shown in detail, are provided for driving the shell illustrated at the arrowed line F. A suitable drive means for rotating the auger is shown at the arrowed line G.

The heavy phase openings 8 are located at a radial distance H from an axis 7 of the shell. The openings are arranged in the layer 14 of the heavy phase. The liquid phase material is shown at 15 within the separator and is maintained at a level 13*b*.

The layer 14 of the heavy phase material is at a greater radial distance from the axis 7 of the centrifuge than the liquid level 13*a*. The separation is, of course, obtained by centrifugal forces caused by the rotational speed of the centrifuge shell.

In one form, additional heavy phase openings 12 may be provided which are arranged in the cylindrical basket shell section and preferably toward the second end of the cylindrical portion of the shell.

The optional second heavy phase discharge opening 12 has a flow area E which is fixed for a constant discharge of heavy phase material. The principal heavy phase flow opening 8 has a cross-sectional area D. In one form, means are provided for varying this cross-sectional area D such as by controlling the size through valve means or replacing the nozzle. Further in one form, the nozzle 8 may be axially movable as indicated schematically by the doubled arrowed line 17. With this arrangement, the nozzle opening 8 can be moved further into the shell to reduce the radial dimension H and reduce the hydraulic pressure head being exerted to force the heavy phase material from the shell. In all instances, the size of the opening 8 is such that it throttles the flow of heavier phase material so that the opening is always submerged and hydraulic pressure is always acting to force the heavy phase material out through the opening 8.

As stated earlier herein, the second heavy phase opening 12 if used, accommodates a relatively continuous flow of heavy phase material and the opening 8 essentially throttles or regulates the quantity of heavy phase flowing from the shell.

The auger is supported on a hollow shaft 6 through which slurry is introduced at 2 to pass into the interior of the centrifuge. The hollow shaft 6 forms a carrying member of the screw conveyor worm 5 which is arranged concentrically relative to the basket shell 4. The screw conveyor conveys the heavy phase 14 in an axial direction toward the second end or the conical part 9 of the drum. The heavy phase then is expressed through the discharge openings 12 at the second end of the cylindrical drum part and through the discharge openings 8 at the axial second end of the conical drum part. It will be understood that an arrangement of openings such as 8 and 12 are provided spaced circumferentially and extending uniformly around the circumference of the shell.

The light phase fraction 15 which is separated from the heavy phase is discharged at discharge openings 3 which are located in the end wall 10 at the first end of the shell, which is the opposite direction of flow of the heavy phase. The discharge openings 3 for the light phase are also narrowly dimensioned so that their cross-sectional area exerts a throttle effect on the light phase 15 to be discharged. As a result of this sizing, the liquid level 13*b* is raised compared to the location of the discharge opening at a shorter radial distance B from the drum axis. The radial distance of the opening 3 is shown at the radial distance A from the drum axis. The flow area of the opening 3 is designated as C. In certain constructions, it may be desirable to fashion the opening 3 as a replaceable opening so that the flow area can be changed. Also, the opening 3 can be constructed so as to be movable in a radial direction as indicated schematically by the double arrowed line 18.

The discharge openings 8 for the heavy phase and/or the discharge openings 3 for the light phase are adjusted such that their radial position and/or their cross-sectional area can be varied. This can be done during operation or during standstill of the machine. The relative locations and/or the relative cross-sectional areas are set so that the discharged quantity of the light phase to the heavy phase change in the same ratio with a change of the conditions or amount of the entering slurry. In other words, if the ratio of light phase to heavy phase material is to be A/B, the rate of effective area of the opening 3 to the effective area of the opening 8 is A/B.

FIG. 2 illustrates another form of the invention. In FIG. 2, similar parts are numbered with the same numerals. In FIG. 2 a retainer means 16 is provided which in a preferred form is an annular disk extending radially from the auger shaft 6 and carried thereon. The disk 16 extends radially outwardly to allow a small space between its outer edge and the inner surface of the cylindrical portion of the shell 4 which provides an axial passage for the heavy phase of material. As will be noted in the drawing, the disk 16 provides a barrier preventing the flow of liquid from the light phase 15 into the heavy phase area of the shell 4. This barrier 16 prevents the passage of liquid into the heavy phase portion which can occur with substantial fluctuations in the intake. The barrier coacts with the regulating function of the discharge openings 3 and 8 to maintain a hydraulic head for the light phase and the heavy phase.

The drawings illustrate a separator wherein the heavy phase and light phase fractions move in opposite directions. The principles of the invention can be employed in a co-current flow principle separator or a separator used for separating or thickening. It is possible to arrange and fashion the discharge openings for the heavy phase at the end wall on the second end on the right side of the drawing of FIG. 2 where a centrifuge is utilized which has no conical portion.

In operation, with reference to FIG. 1, a slurry is admitted at 2 through the hollow shaft 6 and is separated by the centrifugal force action of the rotating shell. The heavy phase passes to the inner surface of the shell and is carried by the auger blades 5 toward the conical end 9 of the shell. The flow opening 8 acts as a throttle maintaining a level of heavy phase material at the discharge opening 8. The discharge opening 8 can be modified in flow area D by replacement of the nozzle or in certain constructions, the nozzle can be moved radially in or out as indicated by the arrowed line 17. The light phase flows out through the throttling opening 3 having a flow area C which, due to the throttling effect, maintains a level of the liquid above the opening 3. The ratio of effective flow area of the opening 3 for the light phase fraction and the opening 8 for the heavy phase fraction is such that the same ratio of flows are maintained with variations in the quantity of slurry input at 2. In the arrangement of FIG. 2, additionally barrier plate 16 prevents the light phase liquid 15 from flowing into the heavy phase area 14 with fluctuations in the quantity input of slurry.

Thus, it will be seen that there has been provided an improved centrifuge which operates in accordance with the principles of the invention and achieves the advantages and features above set forth. The structure utilizing the invention is such that it can be easily adapted in new construction or in revisions of existing centrifugal separators.

I claim as my invention:

1. A solid bowl worm centrifuge for the continuous separation of a liquid slurry into a light phase fraction and a heavy phase fraction comprising in combination:

a rotary shell mounted for rotation about a center axis having a predetermined size and having an inlet for a slurry to be separated into a liquid light phase and a heavy phase with the light phase being at a distance from the axis to be at a first level in the shell and the heavy phase being at a distance from the axis to be at a second level;

a discharge opening from the shell for the heavy phase located further from the axis than said first level and being of a size relative to the size of the shell to throttle the flow of the heavy phase so that the opening is always submerged by the heavy phase;

and a discharge opening from the shell for the light phase, said light phase discharge opening having a cross-sectional area relative to the size of the shell to exert a throttling effect on the light phase liquid to be discharged so that the light phase opening is always submerged by the light phase so that a hydrostatic head develops aiding in the discharge of liquid through the light phase opening.

2. A solid bowl worm centrifuge for the continuous separation of a liquid slurry into a light phase fraction and a heavy phase fraction constructed in accordance with claim 1:

wherein the heavy phase opening is spaced a distance from the axis less than an outer shell wall of the rotary shell.

3. A solid bowl worm centrifuge for the continuous separation of a liquid slurry into a light phase fraction and a heavy phase fraction constructed in accordance with claim 1:

wherein the rotary shell has a cylindrical portion and a tapered conical portion and said heavy phase discharge opening is located in the cylindrical part of the basket shell.

4. A solid bowl worm centrifuge for the continuous separation of a liquid slurry into a light phase fraction and a heavy phase fraction constructed in accordance with claim 3:

wherein the heavy phase discharge opening in located in the conical part of the basket shell.

5. A solid bowl worm centrifuge for the continuous separation of a liquid slurry into a light phase fraction and a heavy phase fraction constructed in accordance with claim 4:

wherein the opening for the heavy phase is positioned at an axial end of the conical part of the basket shell.

6. A solid bowl worm centrifuge for the continuous separation of a liquid slurry into a light phase fraction and a heavy phase fraction constructed in accordance with claim 1:

wherein the openings for the light phase and for the heavy phase are shaped as a slot aperture.

7. A solid bowl worm centrifuge for the continuous separation of a liquid slurry into a light phase fraction and a heavy phase fraction constructed in accordance with claim 3:

including a size control for the discharge opening for the heavy phase permitting size adjustment during operation to control the throttling effect of the heavy phase material.

8. A solid bowl worm centrifuge for the continuous separation of a liquid slurry into a light phase fraction and a heavy phase fraction constructed in accordance with claim 1:

wherein the discharge opening for the heavy phase includes a position adjustment for radially moving the location of the opening relative to the axis of the shell for varying the discharge effect of the heavy phase material.

9. A solid bowl worm centrifuge for the continuous separation of a liquid slurry into a light phase fraction and a heavy phase fraction constructed in accordance with claim 1:

wherein said rotary shell has a cylindrical portion and a conical portion, a first heavy phase discharge opening in the conical portion;

and a second heavy phase opening in the cylindrical portion.

10. A solid bowl worm centrifuge for the continuous separation of a liquid slurry into a light phase fraction and a heavy phase fraction constructed in accordance with claim 1:

including a retainer means within the shell providing a barrier between the heavy and light phases within the shell blocking flow of the light phase toward the heavy phase opening.

11. A solid bowl worm centrifuge for the continuous separation of a liquid slurry into a light phase fraction and a heavy phase fraction constructed in accordance with claim 10:

wherein the barrier is in the form of an annular disk providing a barrier and having an axial passage means for the heavy phase flow toward the heavy phase opening.

12. A solid bowl worm centrifuge for the continuous separation of a liquid slurry into a light phase fraction and a heavy phase fraction constructed in accordance with claim 10:

wherein the shell includes a rotatable worm auger within for moving heavy phase material toward the heavy phase opening;;

and a worm member mounted on the auger providing an axial passage at its radial outer edge for movement of the heavy phase material.

13. A solid bowl worm centrifuge for the continuous separation of a liquid slurry into a light phase fraction and a heavy phase fraction comprising in combination:

a rotary shell mounted for rotation about a center axis having a predetermined size and having an inlet for a slurry to be separated into a liquid light phase and a heavy phase with the slurry to be separated in a ratio of the light phase to heavy phase of A/B regardless of quantity of slurry input into the shell;

a discharge opening from the shell for a heavy phase;

a discharge opening from the shell for a light phase; and a cross-sectional area of the light phase opening to the heavy phase opening being in the ratio of A/B whereby the quantity of a light phase and a heavy phase flowing from the shell will be in the ratio of A/B regardless of throughput, said openings each being of a sufficiently small size relative to the shell size to maintain the openings submerged and develop a hydrostatic head and to throttle material flowing through said openings.

14. A solid bowl worm centrifuge for the continuous separation of a liquid slurry into a light phase fraction and a heavy phase fraction comprising in combination:

a rotary shell mounting for rotation about a center axis having a predetermined size and having an axial inlet at a first end for a slurry to be separated into a liquid light phase and a heavy phase with the light phase being at a first level in the shell relative to the axis and the heavy phase being at a second level in the shell relative to the axis;

means for driving the shell in rotation;

a central auger within the shell having a separate means for driving the auger in rotation;

said shell having a cylindrically shaped section at the first end and a conically shaped section at a second end;

a liquid light phase opening located at the axial and of the first end;

a heavy phase opening located at the axial end of the conical portion;

the cross-sectional size of the light phase opening being sufficiently small relative to the shell size to throttle the flow of the lighter phase liquid to maintain the light phase opening submerged;

and the size of the first and second heavier phase openings being such relative to the shell size to throttle the flow of heavier phase material and maintain the heavier phase openings submerged.

* * * * *